US011136865B2

(12) United States Patent
Yu et al.

(10) Patent No.: US 11,136,865 B2
(45) Date of Patent: Oct. 5, 2021

(54) INTEGRATED CONSTRUCTION METHOD OF FRACTURING AND TERTIARY OIL RECOVERY FOR LOW-PERMEABILITY RESERVOIR

(71) Applicant: YANGTZE UNIVERSITY, Jingzhou (CN)

(72) Inventors: Weichu Yu, Jingzhou (CN); Qingwen Zeng, Jingzhou (CN); Ying Zhang, Jingzhou (CN); Xiangsong Xiao, Jingzhou (CN); Shanwen Yu, Jingzhou (CN)

(73) Assignee: YANGTZE UNIVERSITY, Jingzhou (CN)

( * ) Notice: Subject to any disclaimer, the term of this patent is extended or adjusted under 35 U.S.C. 154(b) by 95 days.

(21) Appl. No.: 16/672,467

(22) Filed: Nov. 3, 2019

(65) Prior Publication Data

US 2021/0108491 A1 Apr. 15, 2021

(30) Foreign Application Priority Data

Oct. 11, 2019 (CN) ..... 201910964136.7

(51) Int. Cl.

| | |
|---|---|
| ***E21B 43/26*** | (2006.01) |
| ***E21B 43/114*** | (2006.01) |
| ***E21B 47/003*** | (2012.01) |
| ***E21B 21/08*** | (2006.01) |
| ***E21B 43/20*** | (2006.01) |

(52) U.S. Cl.
CPC ..... *E21B 43/114* (2013.01); *E21B 21/08* (2013.01); *E21B 43/20* (2013.01); *E21B 43/261* (2013.01); *E21B 47/003* (2020.05)

(58) Field of Classification Search
CPC ..... E21B 43/26; E21B 43/27
See application file for complete search history.

(56) References Cited

U.S. PATENT DOCUMENTS 10,364,672 B2 * 7/2019 Centurion ..... G01V 1/40
10,988,675 B2 * 4/2021 Riley ..... C09K 8/68
(Continued)

*Primary Examiner* — Kipp C Wallace
(74) *Attorney, Agent, or Firm* — Hemisphere Law, PLLC; Zhigang Ma

(57) ABSTRACT

Disclosed is an integrated construction method of fracturing and tertiary oil recovery for low-permeability reservoir, including the following steps: dividing the target layer into several fracturing intervals; determining the amount of fracturing fluid required for the target fracturing interval; determining the flow rate of the target fracturing interval; determining the pumping construction procedure for the target fracturing interval; perforating the target fracturing interval; injecting oil displacement fracturing fluid into the target fracturing interval for fracturing construction; wherein the oil displacement fracturing fluid is a fracturing fluid to which an oil displacement agent is added. The beneficial effect of the technical scheme proposed in this disclosure is: by adding an oil displacing agent to the fracturing fluid, the fracturing and tertiary oil recovery are integrated, thereby improving the effect of fracturing and tertiary oil recovery, while also avoiding the water lock effect of the reservoir. Compared with the existing "first fracturing then tertiary oil recovery" scheme, it has obvious advantages.

6 Claims, 2 Drawing Sheets

(56) References Cited

U.S. PATENT DOCUMENTS

| | | | | |
|---|---|---|---|---|
| 2008/0314591 | A1* | 12/2008 | Hales | E21B 33/134 166/285 |
| 2012/0024525 | A1* | 2/2012 | Svarczkopf | C09K 8/62 166/267 |
| 2012/0267104 | A1* | 10/2012 | Clarkson | E21B 43/267 166/280.1 |
| 2014/0222405 | A1* | 8/2014 | Lecerf | E21B 43/26 703/10 |
| 2015/0284811 | A1* | 10/2015 | Knight | C12Q 1/6874 506/2 |
| 2015/0353815 | A1* | 12/2015 | Kurkal-Siebert | C09K 8/80 166/308.2 |
| 2017/0051195 | A1* | 2/2017 | Vanzin | C09K 8/584 |
| 2017/0114613 | A1* | 4/2017 | Lecerf | E21B 41/0092 |
| 2017/0275988 | A1* | 9/2017 | Centurion | E21B 43/119 |
| 2018/0371883 | A1* | 12/2018 | Enkababian | E21B 49/00 |
| 2019/0040726 | A1* | 2/2019 | Deutch | E21B 43/26 |
| 2019/0264096 | A1* | 8/2019 | Eluru | C09K 8/887 |
| 2020/0048532 | A1* | 2/2020 | Vigderman | E21B 43/267 |
| 2020/0378229 | A1* | 12/2020 | Kurison | E21B 33/12 |

* cited by examiner

INTEGRATED CONSTRUCTION METHOD OF FRACTURING AND TERTIARY OIL RECOVERY FOR LOW-PERMEABILITY RESERVOIR

FIELD OF THE DISCLOSURE

The disclosure relates to an integrated construction method of fracturing and tertiary oil recovery for low-permeability reservoir.

BACKGROUND

Based on the injection time and function of the fracturing fluid, the fracturing fluid can be divided into preflush, sand-laden fluid and displacement fluid. The preflush is usually injected at a high flow rate to rapidly increase the pressure of the fracturing fluid. When the pressure is greater than the fracture pressure of the reservoir rock, the rock is broken, and then the sand-laden fluid and the displacement fluid are injected successively to finally complete the whole fracturing operation. In the conventional fracturing process, the fracturing fluid only plays the role of increasing pressure and carrying sand.

The conventional tertiary oil recovery construction method is to first prepare the oil displacement agent, and then use the plunger pump of the injection plant to increase the pressure, and then pump oil displacement agent into the ground injection pipe. Then, oil displacement agent is transported to the bottom of the well through a downhole injection pipe, and finally injected into the oil layer through the perforation hole. For conventional tertiary oil recovery, the oil displacement agent only plays the role of oil displacement.

As a process to improve oil recovery, fracturing and tertiary oil recovery have the same purpose, both to improve the recovery of the reservoir. The conventional practice is to "first fracturing then tertiary oil recovery". Before tertiary oil recovery, the fracturing fluid should be flowed back, but the prior art is difficult to completely flow back the fracturing fluid, which will cause water lock effect on the reservoir, affecting the subsequent injection of the oil displacement agent and the oil displacing effect.

SUMMARY

A technical problem to be solved by the disclosure is to provide a fracturing and tertiary oil recovery construction method that not only increases the productivity of fracturing and tertiary oil recovery, but also overcomes the water lock effect of the reservoir.

An integrated construction method of fracturing and tertiary oil recovery for low-permeability reservoir, including the following steps:

dividing the target layer into several fracturing intervals;

determining the amount of fracturing fluid required for the target fracturing interval;

determining the flow rate of the target fracturing interval;

determining the pumping construction procedure for the target fracturing interval;

perforating the target fracturing interval;

injecting oil displacement fracturing fluid into the target fracturing interval for fracturing construction;

wherein the oil displacement fracturing fluid is a fracturing fluid to which an oil displacement agent is added.

The beneficial effect of the technical scheme proposed in the present invention is: by adding an oil displacing agent to the fracturing fluid, the fracturing and tertiary oil recovery are integrated, thereby improving the effect of fracturing and tertiary oil recovery, while also avoiding the water lock effect of the reservoir. Compared with the existing "first fracturing then tertiary oil recovery" scheme, it has obvious advantages.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
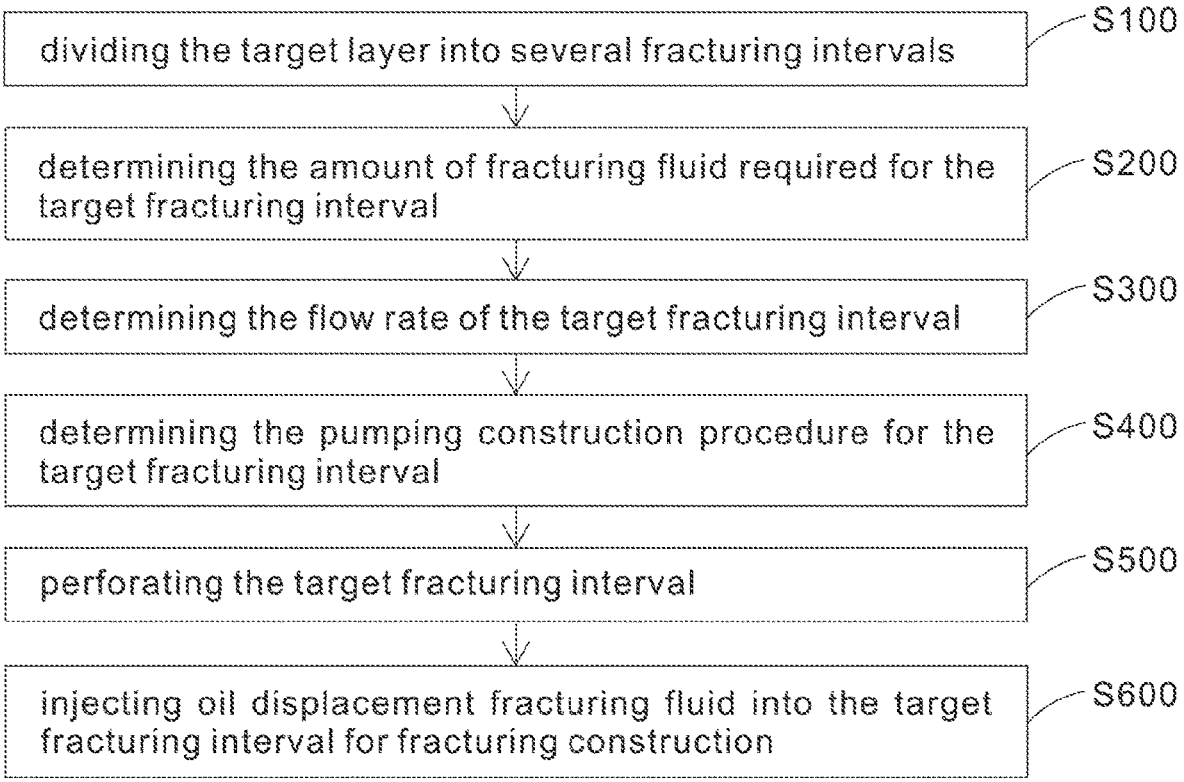
FIG. 1 is a flow chart of a preferred embodiment of an integrated construction method of fracturing and tertiary oil recovery for low-permeability reservoir provided by this disclosure.

In order to verify the feasibility of this disclosure, a well was selected as an example. The well was drilled to a depth of 2690.00 meters and had a formation pressure coefficient of 1.00. The integrated method of tertiary oil recovery in low permeability reservoir provided by this disclosure is used for fracturing design and construction of the well. As illustrated in FIG. 1, the fracturing design and construction include the following steps:

S100 dividing the target layer into several fracturing intervals;

S200 determining the amount of fracturing fluid required for the target fracturing interval;

S300 determining the flow rate of the target fracturing interval;

S400 determining the pumping construction procedure for the target fracturing interval;

S500 perforating the target fracturing interval;

S600 injecting oil displacement fracturing fluid into the target fracturing interval for fracturing construction;

wherein the oil displacement fracturing fluid is a fracturing fluid to which an oil displacement agent is added.

The mechanism of the integrated low-permeability reservoir fracturing tertiary recovery construction method provided by this disclosure is that the fracturing fluid used in the conventional fracturing construction does not contain the oil displacing agent, and the fracturing fluid only plays the role of increasing pressure and carrying sand, and does not have the effect of oil displacement. However, the fracturing fluid used in the fracturing construction of this disclosure is an oil displacement fracturing fluid containing an oil displacing agent, which can not only increase pressure and carry sand, but also have the effect of oil displacement, which is conducive to improving oil recovery.

Furthermore, the specific steps of Step S100 are:

Determining the segmentation points of each fracturing interval one by one, the method of determining the segmentation points is: the initial position of a segmentation point is obtained by moving a preset distance backwards on the basis of the previous segmentation point, and then calculate the difference between formation pressure at the initial position and formation pressure at the previous segmentation point, if the difference of the formation pressure is less than a preset tolerance value, the initial position is used as the position of the segmentation point; otherwise, moving the position of the segmentation point so that the difference of formation pressure between the segmentation point and the previous segmentation point is less than the preset tolerance value. In this embodiment, the preset distance is 100 meters, and the number of the fracturing intervals is 2 intervals.

Figure 2:
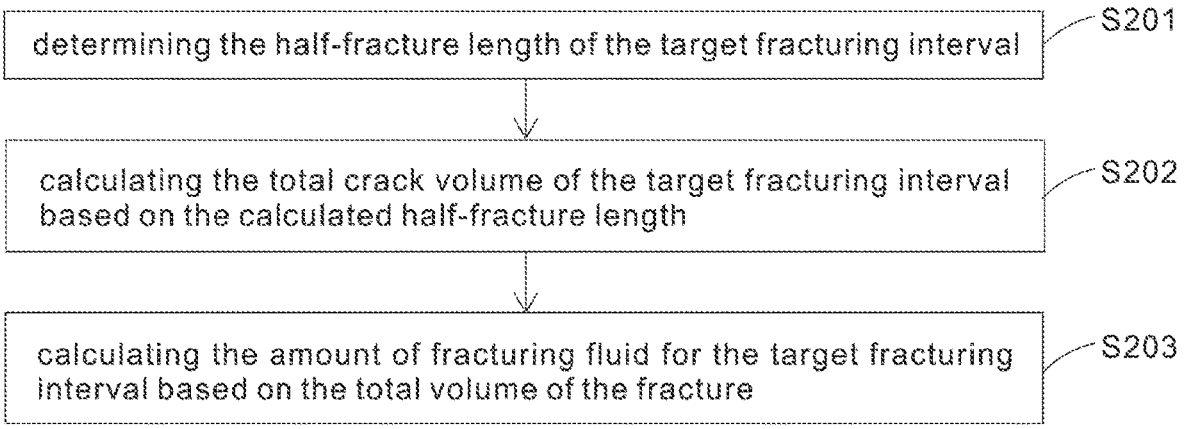
FIG. 2 is a flow chart of a preferred embodiment of Step S200 of an integrated construction method of fracturing and tertiary oil recovery for low-permeability reservoir provided by this disclosure.

Furthermore, as illustrated in FIG. 2, the specific steps of step S200 are:

S201 determining the half-fracture length of the target fracturing interval, which is the half of the distance extending from the wellbore to both sides, i.e., the radius. In densely spaced wells, the half-fracture length of a well should not exceed ⅓ of the well spacing in principle to avoid turbulence between adjacent wells. Except in special circumstances, for example, the direction of the crack is staggered, that is, not in a line, the half-fracture length can be extended appropriately;

S202 calculating the total crack volume of the target fracturing interval based on the calculated half-fracture length; when the half-fracture length is determined, the length, width and height of the crack are determined, so the total volume of the crack can be calculated;

S203 calculating the amount of fracturing fluid for the target fracturing interval based on the total volume of the fracture, wherein the amount of fracturing fluid in the target fracturing interval is equal to the sum of the total fracture volume and the fracture wall filter losses of the target fracturing interval, the fracture wall filter losses can be determined experimentally.

Figure 3:
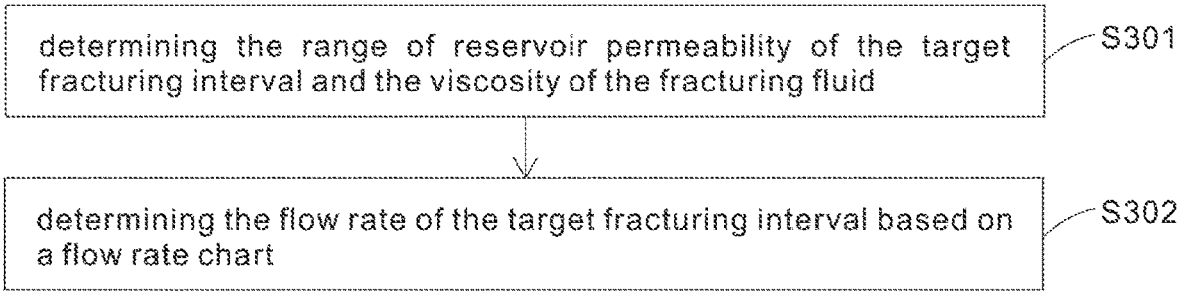
FIG. 3 is a flow chart of a preferred embodiment of Step S300 of an integrated construction method of fracturing and tertiary oil recovery for low-permeability reservoir provided by this disclosure.

Furthermore, as illustrated in FIG. 3, the specific steps of step S300 are:

S301 determining the range of reservoir permeability of the target fracturing interval and the viscosity of the fracturing fluid; the reservoir permeability of the target fracturing interval can be calculated from logging data. The viscosity of the fracturing fluid can be determined on site;

S302 determining the flow rate of the target fracturing interval based on a flow rate chart; the flow rate chart can be drawn according to relevant industry standards, or refer to the flow rate charts of nearby blocks.

Figure 4:
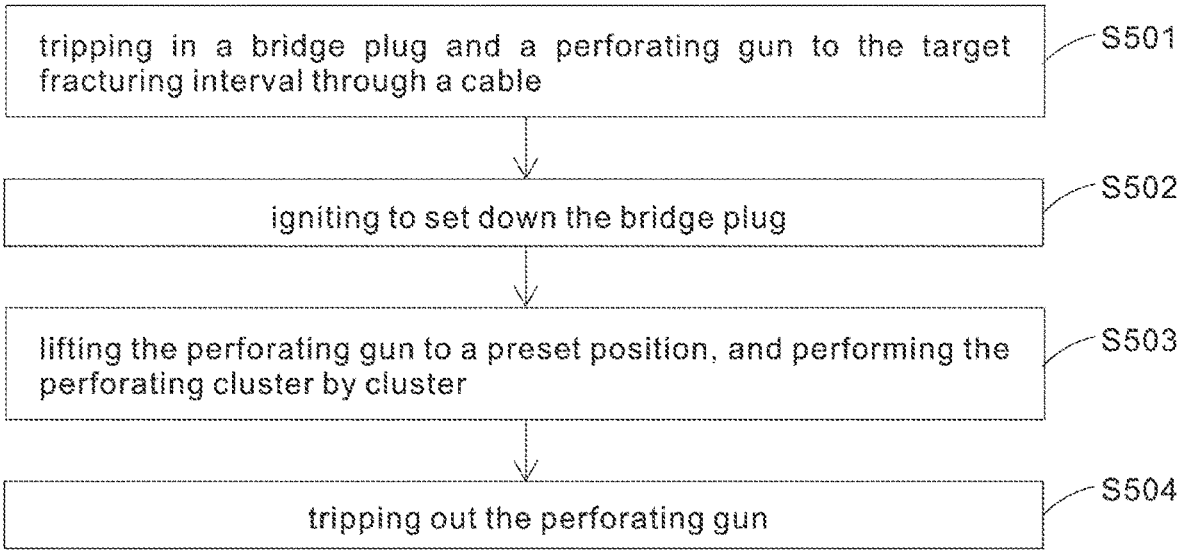
FIG. 4 is a flow chart of a preferred embodiment of Step S500 of an integrated construction method of fracturing and tertiary oil recovery for low-permeability reservoir provided by this disclosure.

Furthermore, as illustrated in FIG. 4, the specific steps of step S500 are:

S501 tripping in a bridge plug and a perforating gun to the target fracturing interval through a cable, the perforating gun is connected to the cable;

S502 igniting to set down the bridge plug;

S503 lifting the perforating gun to a preset position, and performing the perforating cluster by cluster; the perforation is performed with a large aperture (greater than 10 mm), the penetration depth is greater than 400 mm, and the number of perforation holes of each fracturing interval is 30, and the perforating fluid is the same as the oil displacement fracturing fluid;

S504 tripping out the perforating gun.

Furthermore, After the target fracturing interval is perforated, injecting the acid solution into the target fracturing interval for acidification. In this embodiment, the acid solution is 12% dilute hydrochloric acid. The acidification treatment of the hole can remove the hole plug, dredge the hole, reduce the fracture pressure and hole resistance, and lay a foundation for the subsequent fracturing construction.

Specifically, after the acidification of the perforations of the target fracturing interval, the oil displacement fracturing fluid is injected into the target fracturing interval according to the pumping construction procedure for fracturing operation. According to the design requirements, the pressure of the ground fracturing pump must be less than 50 MPa. During the fracturing construction, observing the fracture changes and piercement in the well and adjacent wells. If any problems are found, stopping the pump and closing the pressure source, then releasing the pressure until there is no pressure display and no liquid flow out before inspection.

Specifically, after the end of the fracturing operation of the target fracturing layer, throwing a ball to the ball seat of the bridge plug to seal the fractured interval, and then applying a pressure test to the sealed interval with a pressure of 50 MPa, keeping this pressure for 30 minutes, if the pressure drop is less than 0.5 Mpa, the sealing is qualified, otherwise, it means that the sealing interval is not tightly sealed and needs to be re-sealed and re-tested until passing the pressure test.

Specifically, after the pressure test is passed, continuing the perforating operation, the acidizing operation and the fracturing operation of the next fracturing interval according to the perforation requirements until the perforation, acidification and fracturing are completed in all the fracturing intervals. Then shutting in the well for a period of time for soaking. In this embodiment, the soaking time is 15 days, and recording the wellbore pressure on time during the soaking time. After the soaking is completed, installing the nozzle as required to discharge the fluid until the pressure at the wellhead drops to zero. If the bridge plug is a soluble bridge plug, the soluble bridge plug can be dissolved during the soaking time. After the soaking is completed, tripping in a string to remove the remaining bridge plug and grit. Then the pump can be put into production according to the requirements of the geological plan.

Preferably, the composition of the oil displacement fracturing fluid is: 0.1% drag reducer+0.2% multifunctional additive+0.05% fungicide+0.5% HE-BIO bio-displacement agent+99.15% water, wherein the drag reducer is a new fourth-generation slick water which is cheap, self-cleaning, non-toxic, reusable, environmentally friendly with little damage to the formation, and easy to return. The viscosity of the slick water is low, and its sand carrying capacity is not as good as that of the liquid cement, so it needs to be injected with high flow rate, using mechanical kinetic energy to compensate for the lack of buoyancy. Because of its low viscosity, slick water encounters less resistance to the liquid cement in the formation during fracturing, resulting in longer and more complex fractures in the condition of high flow rate, which is beneficial to increase the total volume of fractures in low permeability reservoirs, thereby increasing the production of oil; HE-BIO bio-displacement agent needs to do compound formulation experiments combined with formation temperature, fracturing fluid, solid crude oil and water before use. HE-BIO bio-displacement agent can reduce the surface tension of fracturing fluid to below 30 mN/m, and can also reduce the interfacial tension of oil-water to $10^{-2}$ mN/m, which can effectively reduce the viscosity of crude oil and clean the oil sands, and in the process of soaking, HE-BIO bio-displacement agent can generate carbon dioxide in situ in the reservoir, thereby further improving the oil displacement effect.

It should be noted that oil displacement fracturing fluid can be divided into preflush, sand-laden fluid and displacement fluid according to the injection time and the function performed. In this embodiment, the composition of these three types of fracturing fluids are the same, except that the sand-laden fluid is also added with a proppant. In the fracturing process, a preflush is first injected to create fractures, and then a sand-laden fluid is injected to feed the proppant into the fractures to support the fractures, finally, a displacement fluid is injected to completely replace the sand-laden fluid in the column into the fractures. The addition of proppant to the fracturing fluid is prior art and will not be described here.

Compared with the adjacent wells, it can be seen that the production of oil is improved by about 10% by using the fracturing and tertiary oil recovery integrated construction method provided by this disclosure.

In summary, by adding an oil displacing agent to the fracturing fluid, the fracturing and tertiary oil recovery are integrated, thereby improving the effect of fracturing and tertiary oil recovery, while also avoiding the water lock effect of the reservoir. Compared with the existing "first fracturing then tertiary oil recovery" scheme, it has obvious advantages.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An integrated construction method of fracturing and tertiary oil recovery for low-permeability reservoir, including the following steps:

dividing the target layer into several fracturing intervals;

determining the amount of fracturing fluid required for a target fracturing interval;

determining the pumping construction procedure for the target fracturing interval;

perforating the target fracturing interval;

injecting oil displacement fracturing fluid into the target fracturing interval for fracturing construction;

wherein the oil displacement fracturing fluid is a fracturing fluid to which an oil displacement agent is added;

wherein the composition of the oil displacement fracturing fluid is: 0.1% drag reducer+0.2% multifunctional additive+0.05% fungicide+0.5% HE-BIO bio-displacement agent+99.15% water.

2. The integrated construction method of fracturing and tertiary oil recovery according to claim 1, wherein the specific steps of dividing the target layer into several fracturing intervals are:

determining the segmentation points of each fracturing interval one by one, wherein the method of determining the segmentation points is:

obtaining the initial position of a segmentation point by moving a preset distance backwards on the basis of a previous segmentation point;

calculating the difference between formation pressure at the initial position and formation pressure at the previous segmentation point;

if the difference of the formation pressure is less than a preset tolerance value, using the initial position as the position of the segmentation point;

otherwise, moving the position of the segmentation point so that the difference of formation pressure between the segmentation point and the previous segmentation point is less than the preset tolerance value.

3. The integrated construction method of fracturing and tertiary oil recovery according to claim 1, wherein the specific steps of determining the amount of fracturing fluid required for the target fracturing interval are:

determining a half-fracture length of the target fracturing interval;

calculating a total crack volume of the target fracturing interval based on the half-fracture length;

calculating the amount of fracturing fluid for the target fracturing interval based on the total crack volume, wherein the amount of fracturing fluid for the target fracturing interval is equal to the sum of the total crack volume and fracture wall filter losses of the target fracturing interval.

4. The integrated construction method of fracturing and tertiary oil recovery according to claim 1, wherein the specific steps of perforating the target fracturing interval are:

tripping in a bridge plug and a perforating gun to the target fracturing interval;

igniting to set down the bridge plug;

lifting the perforating gun to a preset position, and performing the perforating cluster by cluster;

tripping out the perforating gun.

5. The integrated construction method of fracturing and tertiary oil recovery according to claim 1 or claim 4, wherein after perforating the target fracturing interval, injecting acid into the target fracturing interval for acidification.

6. The integrated construction method of fracturing and tertiary oil recovery according to claim 1, wherein the oil displacement agent can reduce the surface tension of fracturing fluid to below 30 mN/m.

* * * * *